US007628222B2

(12) United States Patent
Yoshimura et al.

(10) Patent No.: US 7,628,222 B2
(45) Date of Patent: Dec. 8, 2009

(54) BREAKER MOUNTING BRACKET

(75) Inventors: Tadashi Yoshimura, Miyaki-gun (JP); Naofumi Haraguchi, Miyaki-gun (JP); Kozo Jono, Miyaki-gun (JP)

(73) Assignee: Toku Pheumatic Tool Mfg. Co., Ltd., Miyaki-gun (JP)

( * ) Notice: Subject to any disclaimer, the term of this patent is extended or adjusted under 35 U.S.C. 154(b) by 663 days.

(21) Appl. No.: 11/206,946

(22) Filed: Aug. 17, 2005

(65) Prior Publication Data

US 2006/0037845 A1 Feb. 23, 2006

(30) Foreign Application Priority Data

Aug. 18, 2004 (JP) ..... 2004-238717

(51) Int. Cl.
*B25D 17/24* (2006.01)

(52) U.S. Cl. ..... 173/162.1; 173/162.2; 173/211

(58) Field of Classification Search ..... 173/162.1, 173/162.2, 210, 211, 185, 190; 299/37.4; 37/403

See application file for complete search history.

(56) References Cited

U.S. PATENT DOCUMENTS

| | | | | |
|---|---|---|---|---|
| 4,724,912 | A | 2/1988 | Miyazaki et al. | |
| 5,285,858 | A | 2/1994 | Okada et al. | |
| 5,370,193 | A * | 12/1994 | Sippus et al. | 173/211 |
| 6,227,307 | B1 | 5/2001 | Lee | |

FOREIGN PATENT DOCUMENTS

| | | |
|---|---|---|
| EP | 0 191 336 | 8/1986 |
| EP | 0 412 203 | 2/1991 |
| EP | 0 884 140 | 12/1998 |
| JP | 09-155766 | 6/1997 |
| JP | 10-1966 | 1/1998 |
| JP | 11-254351 | 9/1999 |
| JP | 2001-162564 | 6/2001 |

* cited by examiner

*Primary Examiner*—Rinaldi I. Rada
*Assistant Examiner*—Nathaniel Chukwurah
(74) *Attorney, Agent, or Firm*—Jordan and Hamburg LLP

(57) ABSTRACT

The present invention provides a breaker mounting bracket a breaker mounting bracket for mounting a breaker body on a distal end of an arm of a working machine or the like. The breaker mounting bracket includes left and right side plates which are arranged to face each other in an opposed manner, an end plate which is provided between proximal end portions of both side plates and forms a connecting portion with a distal end of the arm of the working machine, and resilient bodies which come into contact with and support the breaker body and are mounted on inner sides of the left and right side plates and the end plate.

12 Claims, 9 Drawing Sheets

BREAKER MOUNTING BRACKET

BACKGROUND OF THE INVENTION

1. Field of the Invention

The present invention relates to a breaker mounting bracket, and more particularly to a bracket which is served for mounting a breaker on a distal end portion of an arm of a power shovel or the like.

2. Explanation of the Related Arts

Conventionally, the mounting of a breaker on a distal end of an arm of a working machine is conducted by way of a bracket.

In performing a crushing operation using the breaker which is hydraulically operated, the vibrations attributed to an impact of the crushing operation are transmitted to the arm and, thereafter, are transmitted to the working machine and hence, it is difficult for an operator to smoothly manipulate the breaker. Accordingly, there has been proposed a technique which mounts a buffer device on a bracket to which the breaker is mounted (see Japanese Patent Laid-open Hei9 (1997)-155766).

The buffer device disclosed in Japanese Patent Laid-open Hei9 (1997)-155766 includes a mounting body which is mounted on a bracket, an engaging body which is engaged with a breaker body and a buffer resilient body which is interposed between the mounting body and the engaging body. Here, on either one of the breaker body and the engaging body, a projection which has a transverse cross section thereof tapered toward another of the breaker body and the engaging body is formed, and on another of the breaker body and the engaging body, a groove portion whose transverse cross section is tapered to conform with the above-mentioned projection and is joined with the projection in tapered fitting are formed.

Further, a planar contact surface is formed on an upper portion of the breaker body and, at the same time, a restricting resilient body which is brought into contact with the contact surface and restricts an upward movement of the breaker is formed on an inner surface of the bracket.

According to the above-mentioned constitution, compared to the constitutions known before the proposal of such a technique, the propagation of an impact toward a working machine side during a breaking operation can be surely suppressed.

SUMMARY OF THE INVENTION

However, the buffer resilient member having the above-mentioned constitution is merely constituted of a buffer resilient body which is interposed between engaging members which are engaged with side portions of the breaker body and a mounting body on which a bracket is mounted, and a restricting resilient body which restricts the upward movement of the breaker. Accordingly, the technique exhibits an insufficient vibration absorbing ability and hence, there has been a strong demand in this technical field for a breaker-use bracket which can sufficiently alleviate the vibrations.

Accordingly, it is an object of the present invention to provide a breaker mounting bracket which can overcome the above-mentioned drawback.

According to a first aspect of the present invention, there is provided a breaker mounting bracket for mounting a breaker body on a distal end of an arm of a working machine or the like, wherein the breaker mounting bracket includes left and right side plates which are arranged to face each other in an opposed manner, an end plate which is provided between proximal end portions of both side plates and forms a connecting portion with a distal end of the arm of the working machine, and resilient bodies which come into contact with and support the breaker body and are mounted on inner sides of the left and right side plates and the end plate.

According to a second aspect of the present invention, in the above-mentioned breaker mounting bracket of the first aspect of the present invention, the resilient bodies which are mounted on the side plates are constituted of first side resilient bodies which support the breaker body in the longitudinal direction in cooperation with the proximal resilient body mounted on the end plate and the second side resilient bodies which clamp (sandwich) the breaker body from left and right directions.

According to a third aspect of the present invention, there is provided a breaker mounting bracket for mounting a breaker body which mounts a chisel on a distal end thereof on a distal end of an arm of a working machine, wherein the breaker mounting bracket includes a pair of left and right side plates which are mounted on both side surfaces of a breaker body which is formed in a longitudinally elongated rectangular parallelepiped shape, an approximately square end plate which is mounted on proximal ends of the side plates and is mounted on a connecting portion which is connected with the distal end of the arm of the working machine, an end-plate side resilient body which is arranged on an inner side of the end plate and is brought into contact with a proximal end portion of the breaker body which is formed on an inner side of the end plate, first side-plate side resilient bodies which are respectively formed on inner sides of the left and right side plates and support the chisel in the vibration direction cooperatively with the end-plate side resilient body, second side-plate side resilient bodies which are contiguously formed with the first side-plate side resilient bodies and impart a pushing force in the direction orthogonal to the vibration direction, a longitudinal resilient body which brings a proximal end surface of the breaker body into contact with a distal end surface thereof, and third side-plate side resilient bodies which reinforce a supporting force of the breaker body in the direction orthogonal to the vibrating direction.

According to a fourth aspect of the present invention, in the breaker mounting bracket according to the first to third aspects of the present invention, engaging members which are engaged with engaging grooves formed in side surfaces of the breaker body are replaceably mounted on side plates of the breaker mounting bracket.

Due to the above-mentioned constitutions, the present invention can obtain following advantageous effects.

(1) According to the first aspect of the present invention, the breaker mounting bracket includes the left and right side plates which are arranged to face each other in an opposed manner, and the end plate is provided between proximal end portions of both side plates and forms the connecting portion with the distal end of the arm of the working machine, and the resilient bodies which come into contact with and support the breaker body are mounted on inner sides of the left and right side plates and the end plate. Accordingly, the longitudinal vibrations attributed to an impact generated when the breaker body is operated can be suppressed and hence, it is possible to surely prevent the transmission of the vibrations of the breaker to the arm or the like whereby the operability of the working machine is enhanced. Further, since the vibration can be largely suppressed, the possibility that bolts mounted on the bracket are loosened and rupture can be largely reduced whereby the reliability is remarkably enhanced and the maintenance cost can be largely reduced.

(2) According to the second aspect of the present invention, the resilient bodies which are mounted on the side plates are constituted of first side resilient bodies which support the breaker body in the longitudinal direction in cooperation with the proximal resilient body mounted on the end plate and the second side resilient bodies which clamp the breaker body from left and right directions. Accordingly, the breaker body can be supported in a floating state by means of these plurality of resilient bodies and hence, it is possible to more surely prevent the transmission of the vibrations of the breaker to the arm or the like whereby the above-mentioned advantageous effect (1) can be further enhanced.

(3) According to the third aspect of the present invention, the breaker mounting bracket includes the end-plate side resilient body which is arranged on the inner side of the end plate and is brought into contact with the proximal end portion of the bracket body, the first side-plate side resilient bodies which are respectively formed on the inner sides of the left and right side plates and support the chisel in the vibration direction cooperatively with the end-plate side resilient body, the second side-plate side resilient bodies which are contiguously formed with the first side-plate side resilient bodies and impart the pushing force in the direction orthogonal to the vibration direction, the longitudinal resilient body which brings the proximal end surface of the breaker body into contact with the distal end surface, and the third side-plate side resilient bodies which reinforce the supporting force of the breaker body in the direction orthogonal to the vibrating direction. Accordingly, the above-mentioned advantageous effect (1) can be still further enhanced.

According to the fourth aspect of the present invention, the engaging grooves are formed in inner surfaces of the breaker body and the engaging members which are replaceably engaged with the engaging grooves are formed on side plates and hence, in addition to the above-mentioned advantageous effects, it is possible to surely and easily mount the breaker body on the breaker mounting bracket.

Here, the present invention is not limited to the above-mentioned constitutions and various modifications are conceivable without departing from the technical concept of the present invention.

PREFERRED EMBODIMENTS OF THE PRESENT INVENTION

Figure 1:
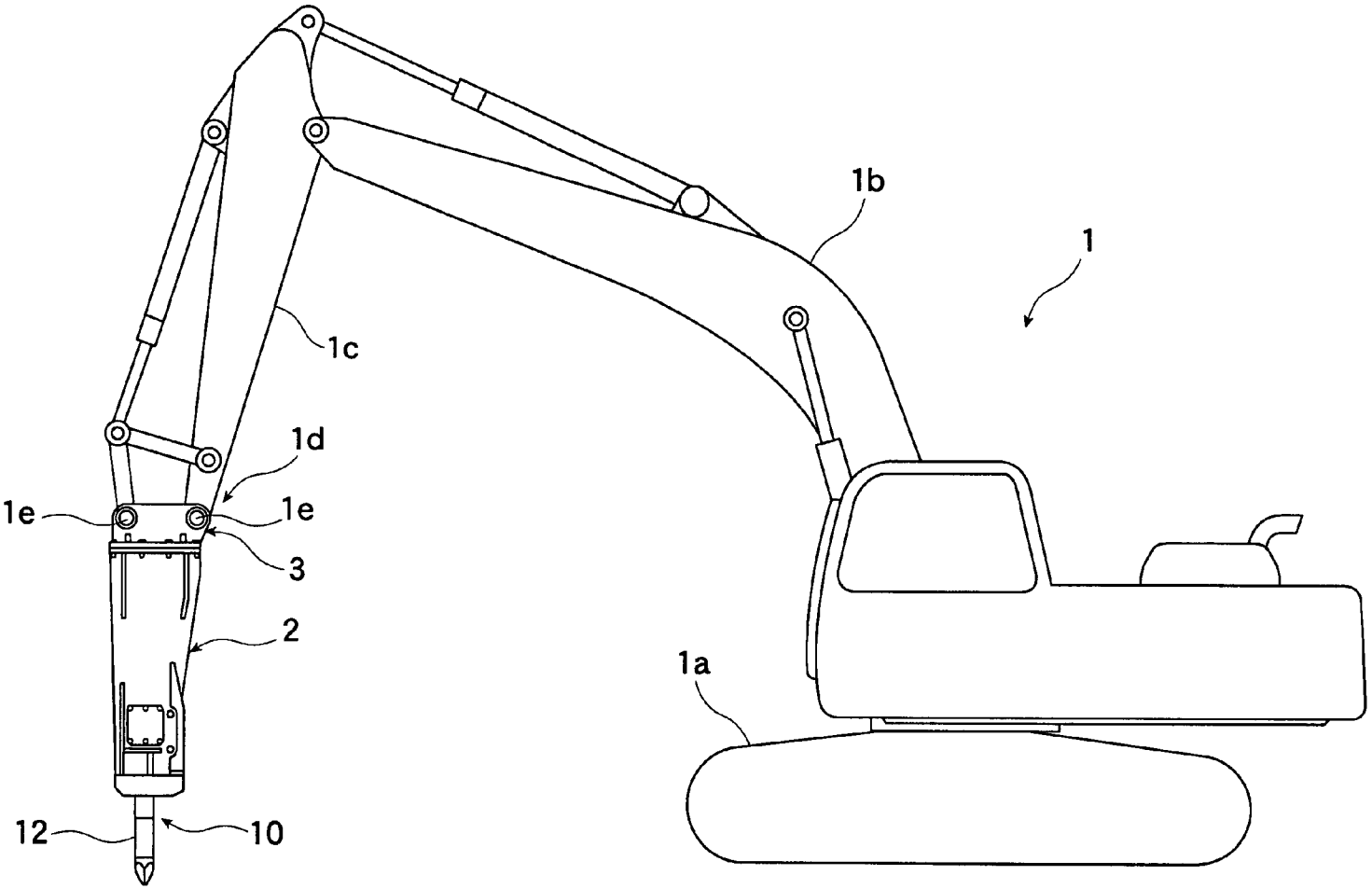
FIG. 1 is an explanatory view of a working machine which uses a breaker mounting bracket of an embodiment 1 of the present invention.

Hereinafter, embodiments of a breaker mounting bracket according to the present invention are explained in conjunction with drawings.

The present invention provides a breaker mounting bracket for mounting a breaker body on a distal end of an arm of a working machine or the like. The breaker mounting bracket includes left and right side plates which are arranged to face each other in an opposed manner, an end plate which is provided between proximal end portions of both side plates and forms a connecting portion with a distal end of the arm of the working machine, and resilient bodies which come into contact with and support the breaker body and are mounted on inner sides of the left and right side plates and the end plate.

That is, in a working vehicle which is provided with an arm such as a power shovel, there may be a case in which a breaker is mounted on a distal end portion of the arm in place of a bucket using the breaker mounting bracket. In this embodiment, the breaker mounting bracket is constituted of the left and right side plates which are arranged to face each other in an opposed manner, the end plate which is provided between the proximal end portions of both side plates and forms the connecting portion with the distal end of the arm of the working machine thus forming a so-called U-shaped-box type bracket. Further, on respective inner sides of the left and right side plates and the end-plate side resilient bodies which come into contact with and support the breaker body are mounted.

Accordingly, it is possible to suppress longitudinal vibrations attributed to an impact generated at the time of operating a breaker body which is mounted in the inside of the bracket and hence, it is possible to surely prevent the transmission of the vibrations of the breaker during the operation whereby there is no possibility that an operator performs an erroneous operation attributed to the vibrations and the operability is remarkably enhanced.

Further, since the vibrations can be largely suppressed, the possibility that bolts mounted on the bracket are loosened and rupture can be largely reduced whereby the reliability is remarkably enhanced and the maintenance cost can be largely reduced.

Further, the resilient bodies which are mounted on the side plates can be constituted of first side resilient bodies which support the breaker body in the longitudinal direction of the breaker body in cooperation with the proximal resilient body mounted on the end plate and the second side resilient bodies which clamp the breaker body from left and right directions.

Due to such a constitution, the breaker body can be supported in a floating state by means of a plurality of resilient bodies and hence, it is possible to more surely prevent the transmission of the vibration of the breaker to the arm or the like. Here, a material of the resilient bodies may be, for example, a rubber material and may be determined in view of the durability, the weatherability and the like.

Further, it is preferable to detachably mount engaging member which are engaged with engaging grooves formed in side surfaces of the breaker body.

Due to such a constitution, in addition to the above-mentioned advantageous effects, it is possible to surely and easily mount the breaker body on the breaker mounting bracket.

Embodiment 1

The embodiment 1 of the present invention is explained specifically in conjunction with attached drawings.

Figure 2:
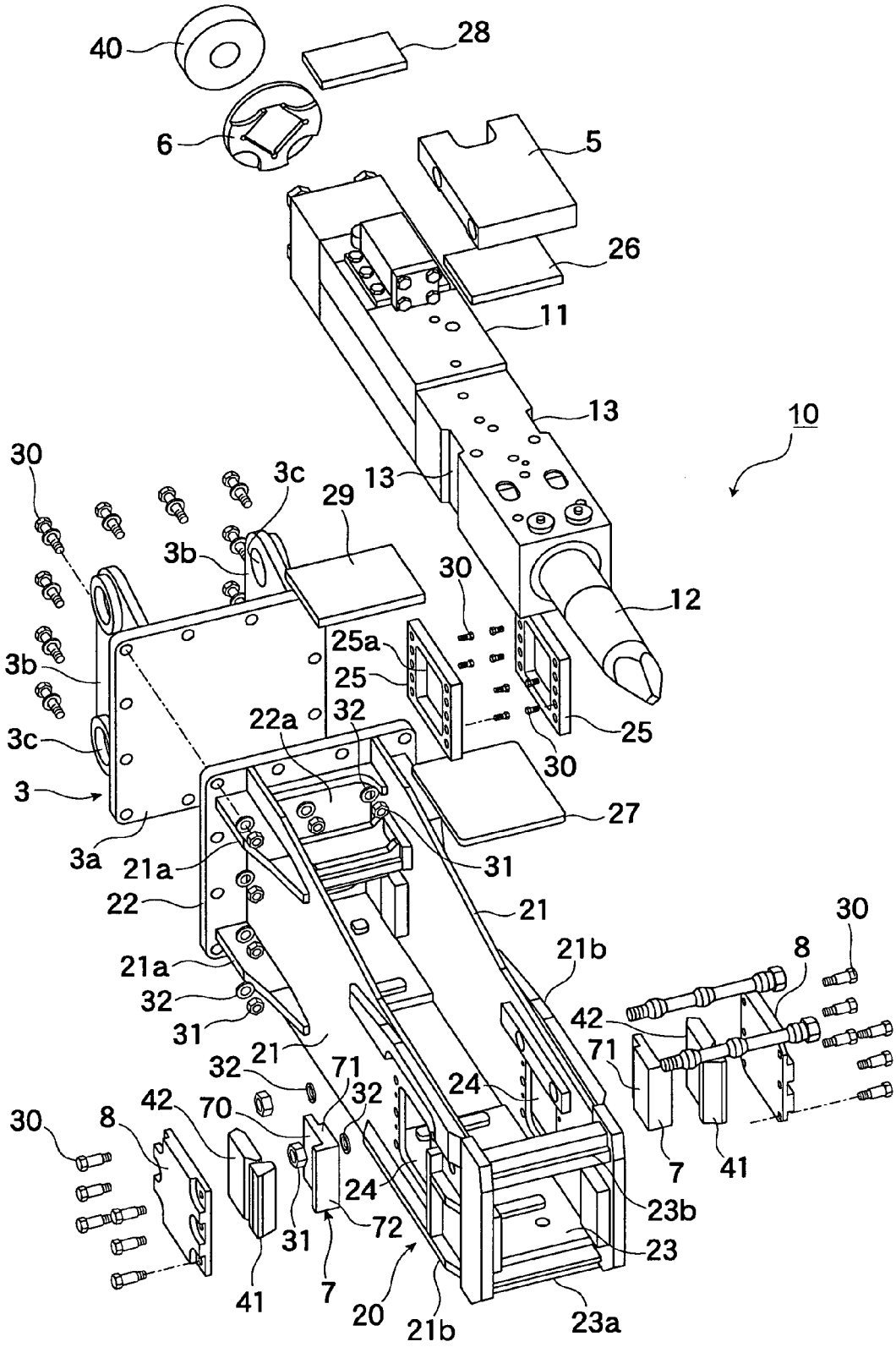
FIG. 2 is an exploded perspective view of the breaker mounting bracket of the embodiment 1 of the present invention.
Figure 3:
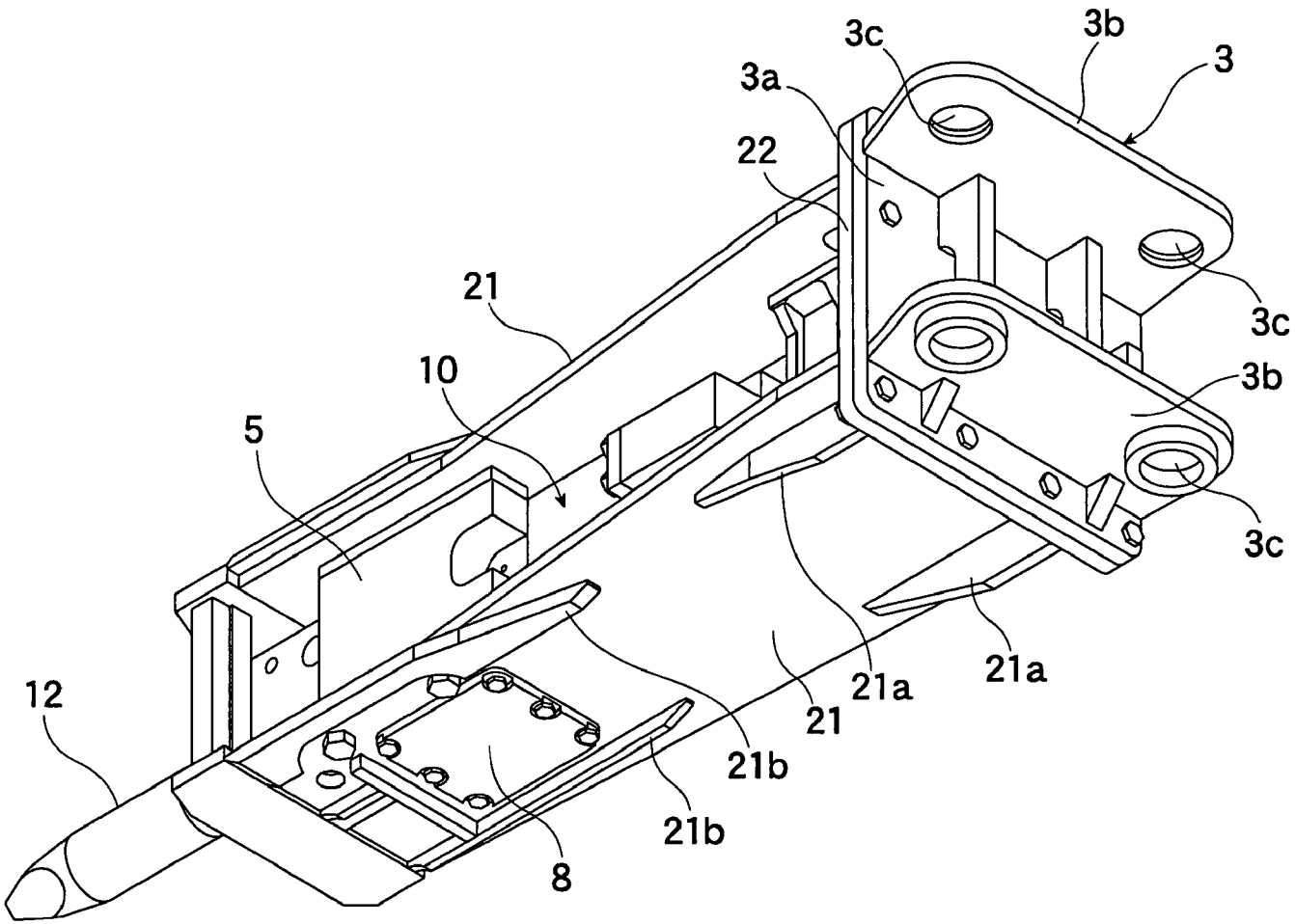
FIG. 3 is a perspective view of the breaker mounting bracket of the embodiment 1 of the present invention.
Figure 4:
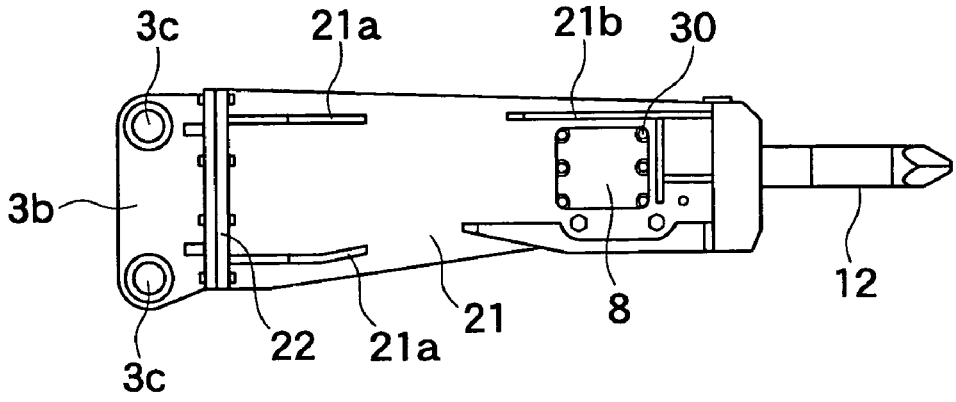
FIG. 4 is a side view of the breaker mounting bracket of the embodiment 1 of the present invention.
Figure 5:
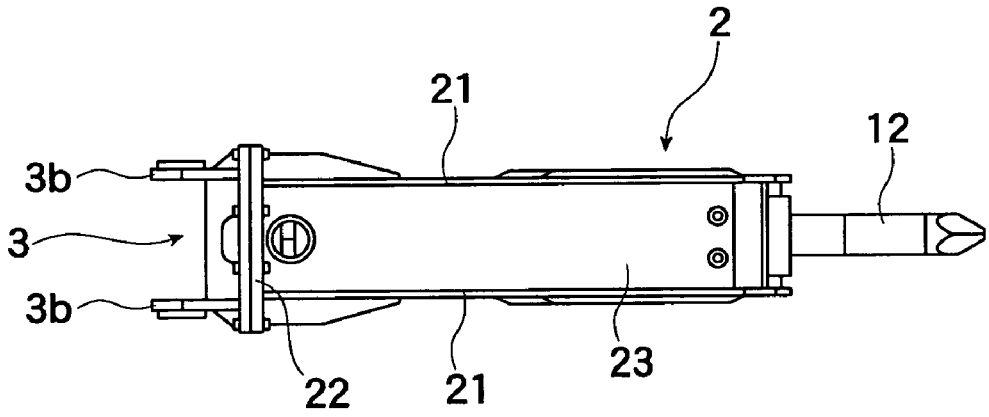
FIG. 5 is a bottom plan view of the breaker mounting bracket of the embodiment 1 of the present invention.
Figure 6:
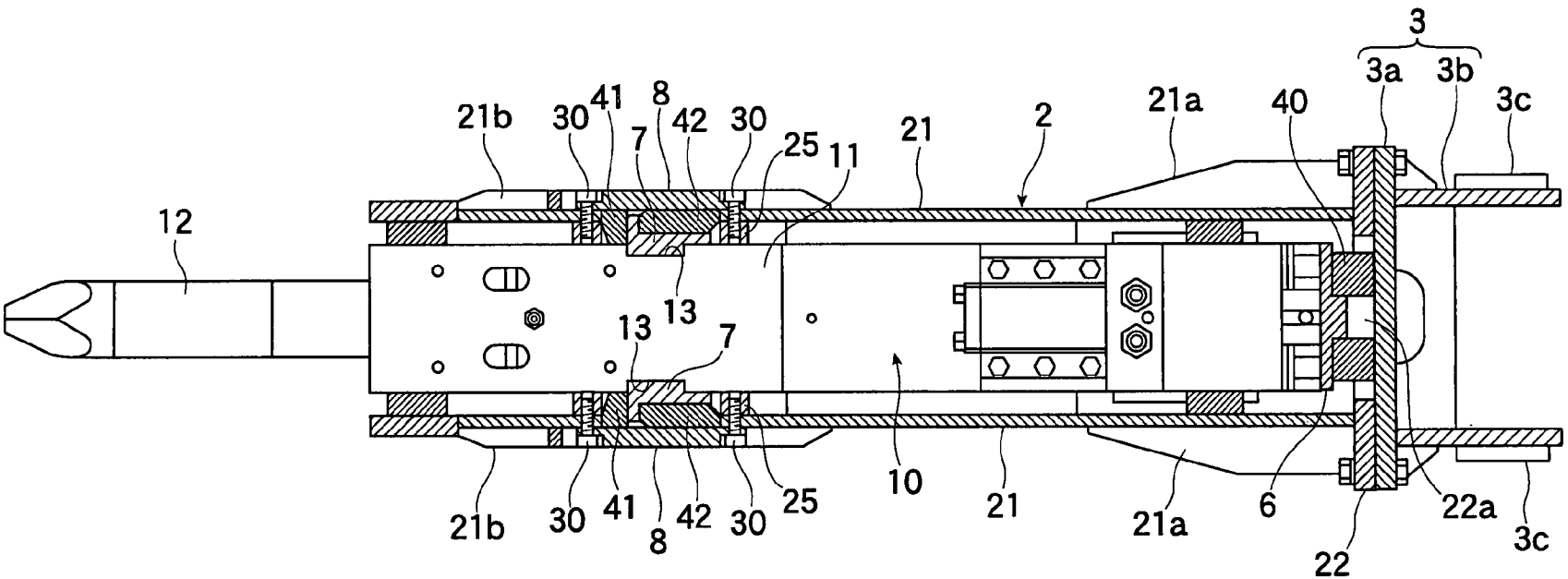
FIG. 6 is a plan view with a part in cross section of the breaker mounting bracket of the embodiment 1 of the present invention.
Figure 7:
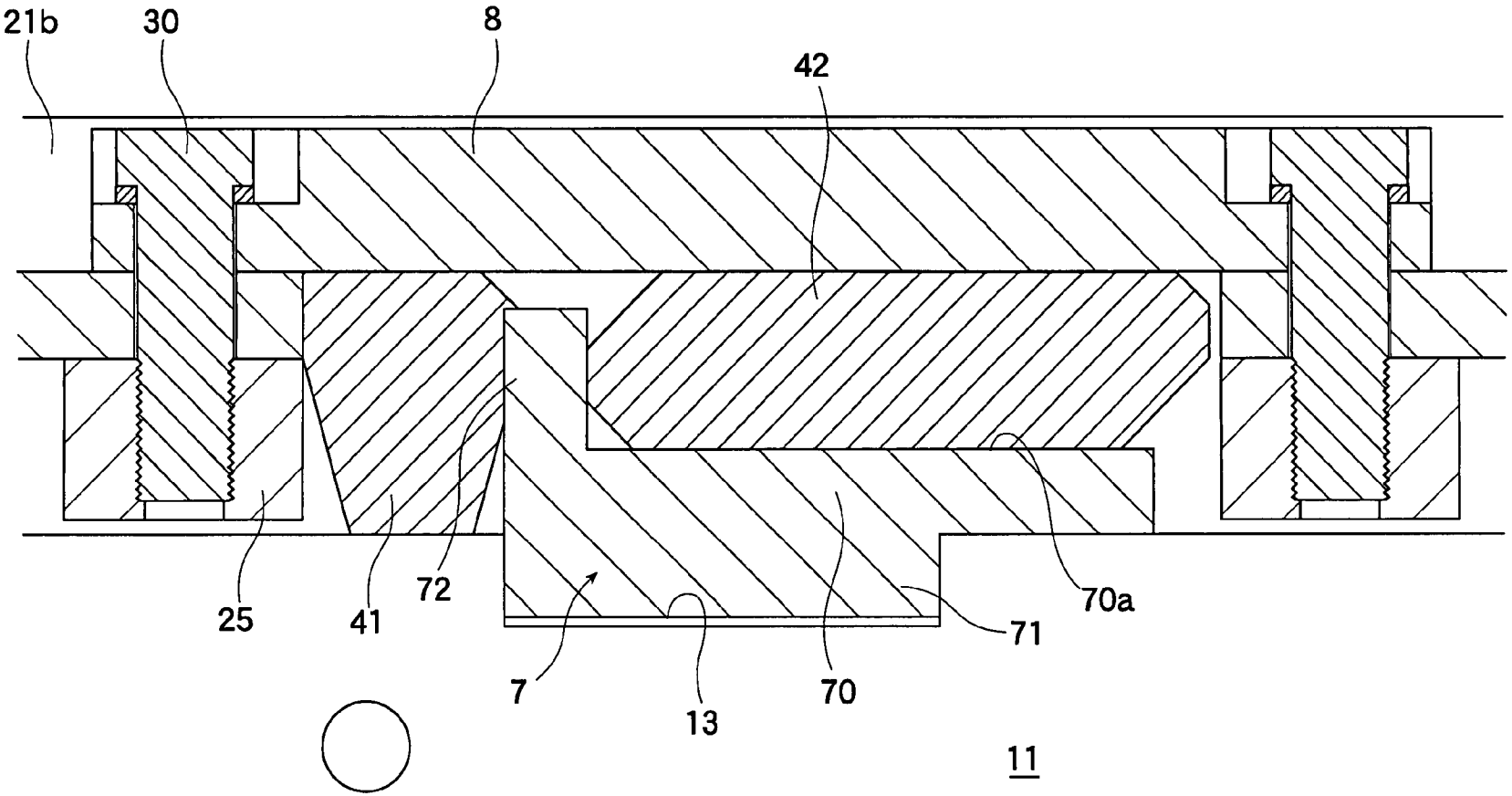
FIG. 7 is an enlarged view of an essential part shown in FIG. 6.

FIG. 1 is an explanatory view of a working machine which uses a breaker mounting bracket (hereinafter referred to as "bracket") of embodiment 1, FIG. 2 is an exploded perspective view of the bracket of the embodiment 1, FIG. 3 is a perspective view of the bracket of the embodiment 1, FIG. 4 is a side view of the bracket of the embodiment 1, FIG. 5 is a bottom plan view of the bracket of the embodiment 1, FIG. 6 is a plan view with a part in cross section of the bracket of this embodiment, and FIG. 7 is an enlarged view of an essential part shown in FIG. 6.

In FIG. 1, numeral 1 indicates the working machine provided with a crawler-type traveling apparatus 1*a*, wherein an arm 1*c* is pivotally connected to the boom 1*b* and a breaker 10 is mounted on a distal end portion of the arm 1*c* by way of the bracket 2 which constitutes a gist of the embodiment 1. Numeral 1*d* indicates a bracket connecting portion which is formed on the distal end of the arm 1*c* and is provided for supporting the bracket 2 on the distal end of the arm 1*c* by way of a pivot pin 1*e* in a state that the bracket 2 is rotatable relative to the arm 1*c*. Numeral 12 indicates a chisel which is mounted on a breaker body 11 (see FIG. 2) of the breaker 10.

As shown in FIG. 2, the breaker 10 includes the breaker body 11 which incorporates a piston (not shown in the drawing) which is reciprocally driven in the longitudinal direction by a hydraulic mechanism therein and a chisel 12 which generates an impact force to an object to be crushed along with the high-speed reciprocating movement of the piston in the longitudinal direction. A pair of key grooves 13, 13 with which keys 7 which constitute engaging members of the bracket 2 described later are formed in left and right side surface of the breaker body 11.

The bracket 2 includes left and right side plates 21, 21 which are arranged to face each other in an opposed manner, an approximately square frame-like end plate 22 which is provided between proximal end portions of both side plates 21, 21 and allows a connecting portions thereof connected to a distal end of the arm 1*c*, a front plate 23 which is mounted between front peripheries of the side plates 21, 21, and a front connecting member 23*a* and a rear connecting member 23*b* which connect distal end portions of the side plates 21, 21, thus forming a bracket body 20 having a U-box shape. Further, the end plate 22 is formed in a frame shape and defines a center opening portion 22*a* for allowing a proximal resilient body 40 described later to pass therethrough. Here, the above-mentioned respective members are preferably made of a steel plate.

In FIG. 2, numeral 5 indicates a guard plate and is mounted between the side plates 21, 21 from a rear side after the breaker body 11 is housed in the inside of the bracket 2. Numeral 21*a* indicates proximal portion reinforcing ribs which are formed on a surface of the side plate 21 and numeral 21*b* indicates distal portion reinforcing ribs which are also formed on the surface of the side plate 21. Further, numeral 24 indicates opening portions which are respectively formed in the left and right side plates 21 at positions slightly close to the distal end portions of the side plates 21 and correspond to the key grooves 13 formed in the breaker body 11. Numeral 25 indicates frame-like key guides which are arranged on the respective side plates 21 in a state that the key guides 25 surround the opening portions 24. The key guides 25 form guide holes 25*a* therein. Further, numeral 26 indicates a front lower spacer, numeral 27 indicates a rear lower spacer, numeral 28 indicates a front upper spacer, and numeral 29 indicates a rear upper spacer. Further, numeral 30 indicates connecting bolts which are used at portions where the connecting bolts 30 are required and numeral 31 indicates nuts which correspond to the connecting bolts 31. Numeral 32 indicates washers.

Further, the connecting portion 3 functions as a bracket for mounting the bracket 2 on the arm 1*c* and is configured such that in the vicinities of left and right end portions of the mounting plate 3*a* which have an approximately square shape substantially equal to the end plate 22 in size, a pair of raised members 3*b* which form pivot pin inserting holes 3*c* therein corresponding to a bracket connecting portion 1*d* mounted on the distal end of the arm 1*c* are mounted in an erected manner.

The breaker 10 is housed and disposed in the bracket body 20 having the above-mentioned constitution and is, as shown in FIG. 3 to FIG. 6, assembled. Here, this embodiment is characterized in that resilient bodies (elastic bodies) which come into contact with and support the breaker body 11 are mounted on inner sides of both of the left and right side plates 21, 21 and the end plate 22 respectively.

Particularly, the resilient bodies mounted on the side plates 21 are constituted of first side resilient bodies 41 which support the breaker body 11 in the longitudinal direction in cooperation with the proximal resilient body 40 which is mounted on the end plate 22, and the second side resilient bodies 42 which clamp the breaker body 11 from the left and right directions (in the lateral direction).

Due to such a constitution, it is possible to support the breaker body 11 in a floating state and hence, the advancing or retracting movement attributed to an impact which is generated when the breaker body 11 is operated can be suppressed whereby it is possible to surely prevent the vibrations of the breaker 10 in the operation from being transmitted to an operator or the like by way of the arm 1*c*, a boom 1*b* and the like of the working machine 1.

Accordingly, there is no possibility that the operator performs an erroneous manipulation due to the vibrations and hence, the operability is remarkably enhanced. Further, since the vibrations can be largely suppressed, the possibility that bolts mounted on the bracket 2 are loosened and rupture can be largely reduced whereby the reliability is remarkably enhanced and the maintenance cost can be largely reduced.

The mounting structure of the above-mentioned resilient bodies is explained hereinafter.

As shown in FIG. 2 and FIG. 6, the proximal resilient body 40 is formed in a ring shape having a given thickness and is interposed between a top plate 6 which comes into contact with a proximal end surface of the breaker body 11 and the connecting portion 3.

Further, as shown in FIG. 7, the first side resilient body 41 and the second side resilient body 42 are mounted on the breaker body 11 by way of the keys 7 made of steel which constitute engaging members, wherein the keys 7 are engaged with the key grooves 13 formed in inner surfaces of the breaker body 11.

As shown in FIG. 7, the key 7 has an approximately L-shaped cross section, wherein a plate body 70 has an engaging portion 71 thereof which is engaged with the key groove 13 formed in a projecting manner and an upright wall portion 72 is formed on a lower end of the plate body 70. In the inside of the guide hole 25*a* formed in the frame-like key guide 25, the engaging portion 71 is detachably engaged with the key groove 13.

Further, between the frame-like key guide 25 and the upright wall portion 72, the first side resilient body 41 which is made of hard rubber or the like and is formed in an approximately rod shape are arranged. Further, in the inside of the guide hole 25*a*, the second side resilient body 42 which is made of hard rubber or the like and is formed in a plate shape is arranged in a state that the second side resilient body 42 comes into contact with an outer surface 70*a* of the plate body 70. A key cover 8 is arranged so as to push both side resilient bodies 41, 42, and the key cover 8 and the frame-like key guide 25 are fastened together using the connecting bolts 30.

Due to the above-mentioned constitution, with the provision of the second side resilient bodies 42, 42 which have a relatively large contact area, it is possible to clamp the breaker body 11 from the left and right directions. Further, while receiving the weight of the breaker body 11 using the first side resilient bodies 41, 41 which are formed in an approximately rod shape and have a relatively large thickness byway of the upright wall portions 72 of the keys 7, the breaker body 11 is clamped between the first side resilient bodies 41, 41 and the proximal resilient body 40 in the longitudinal direction and hence, it is possible to support the breaker body 11 in a floating state. Here, the first side resilient bodies 41 and the second side resilient bodies 42 have shapes which allow the use thereof in both left and right sides. Further, since the first side resilient body 41 is configured to be mounted between the key 7 and the frame-like key guide 25 by driving, a driving side of the first side resilient body 41 is tapered (see FIG. 6 and FIG. 7).

Here, the assembling steps for housing and mounting the breaker body 11 in the inside of the above-mentioned bracket 2 are not limited and it is sufficient that the breaker body 11 is supported in a floating state as the result of assembling.

In this manner, according to the present invention, in performing a rock crushing operation or a drilling operation, for example, by operating the breaker 10 of the working machine 1, the piston of the breaker 10 is longitudinally reciprocated violently at a high speed due to an operation of a hydraulic mechanism. Since the breaker body 11 receives a reaction against acceleration during the advancing of the piston and a reaction when the piston strikes the chisel 12, the breaker body 11 violently is vibrated during the drilling operation or the like. However, in this embodiment, these vibrations are largely alleviated by the base resilient body 40 and the first side resilient bodies 41, 41 and hence, the propagation of the vibrations to the bracket 2 during the drilling operation can be remarkably suppressed. Further, also with the use of the second side resilient bodies 42, 42, it is possible to suppress the propagation of the vibrations attributed to the impact to the bracket 2. Accordingly, it is possible to largely reduce an adverse influence which affects the working machine or the manipulation of an operator in the inside of the working machine by way of the arm 1*c* or the like. Further, due to the large reduction of the vibrations, it is possible to prevent the connecting bolts 30 or the like which are mounted on the bracket 2 as mentioned above from being loosened or being ruptured thus capable of also remarkably enhancing the durability.

Further, in assembling the breaker 10 and the bracket 2, it is sufficient that the keys 7, the first side resilient bodies 41, the second side resilient bodies 42 and the key covers 8 are sequentially mounted in a stacked state in the direction orthogonal to the longitudinal direction of the breaker body 11 (extending direction of the chisel 12) and hence, the assembling property can be extremely enhanced.

Further, in mounting the proximal resilient body 40, the proximal resilient body 40 is arranged on the proximal ends surface of the breaker body 11 by way of the top plate 6 in a state that the mounting plate 3*a* of the connecting portion 3 is preliminarily fastened and, thereafter, the first side resilient bodies 41 are mounted by driving the first side resilient bodies in a state that the keys 7 are mounted in the key grooves 13. Due to a wedge effect generated by this mounting operation, it is possible to strongly clamp the breaker body 11 in the longitudinal direction between the first side resilient member 41 and the proximal portion resilient body 40.

In this manner, since the constitution is simple, along with the above-mentioned suppression of the vibrations, a maintenance cost can be reduced.

Embodiment 2

Figure 8A:
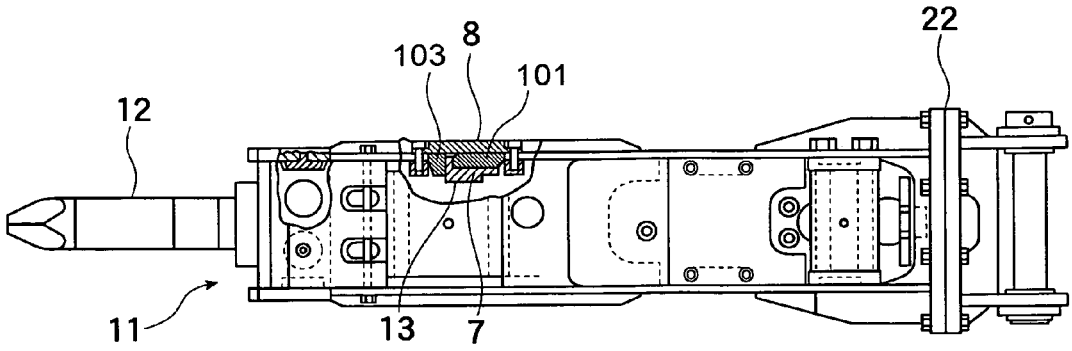
FIG. 8A is a plan view of a breaker mounting bracket of the embodiment 2 of the present invention.
Figure 8B:
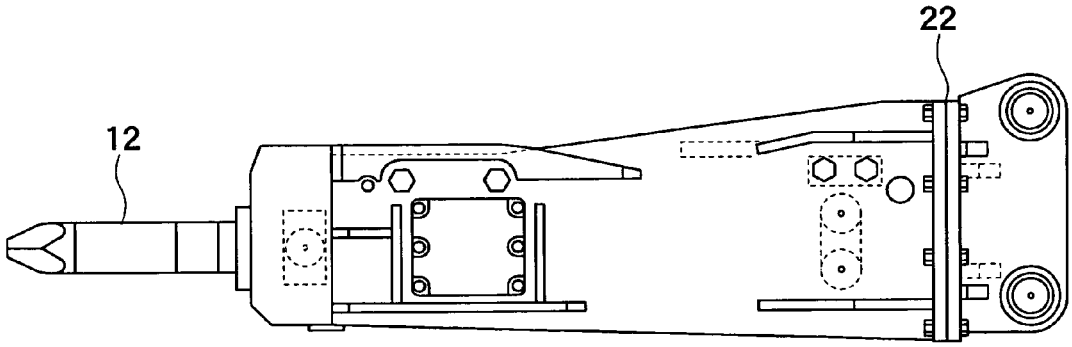
FIG. 8B is a side view of a breaker mounting bracket of the embodiment 2 of the present invention.
Figure 8C:
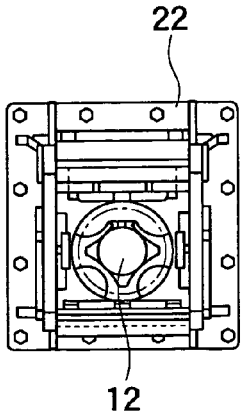
FIG. 8C is a front view of a breaker mounting bracket of the embodiment 2 of the present invention.
Figure 9:
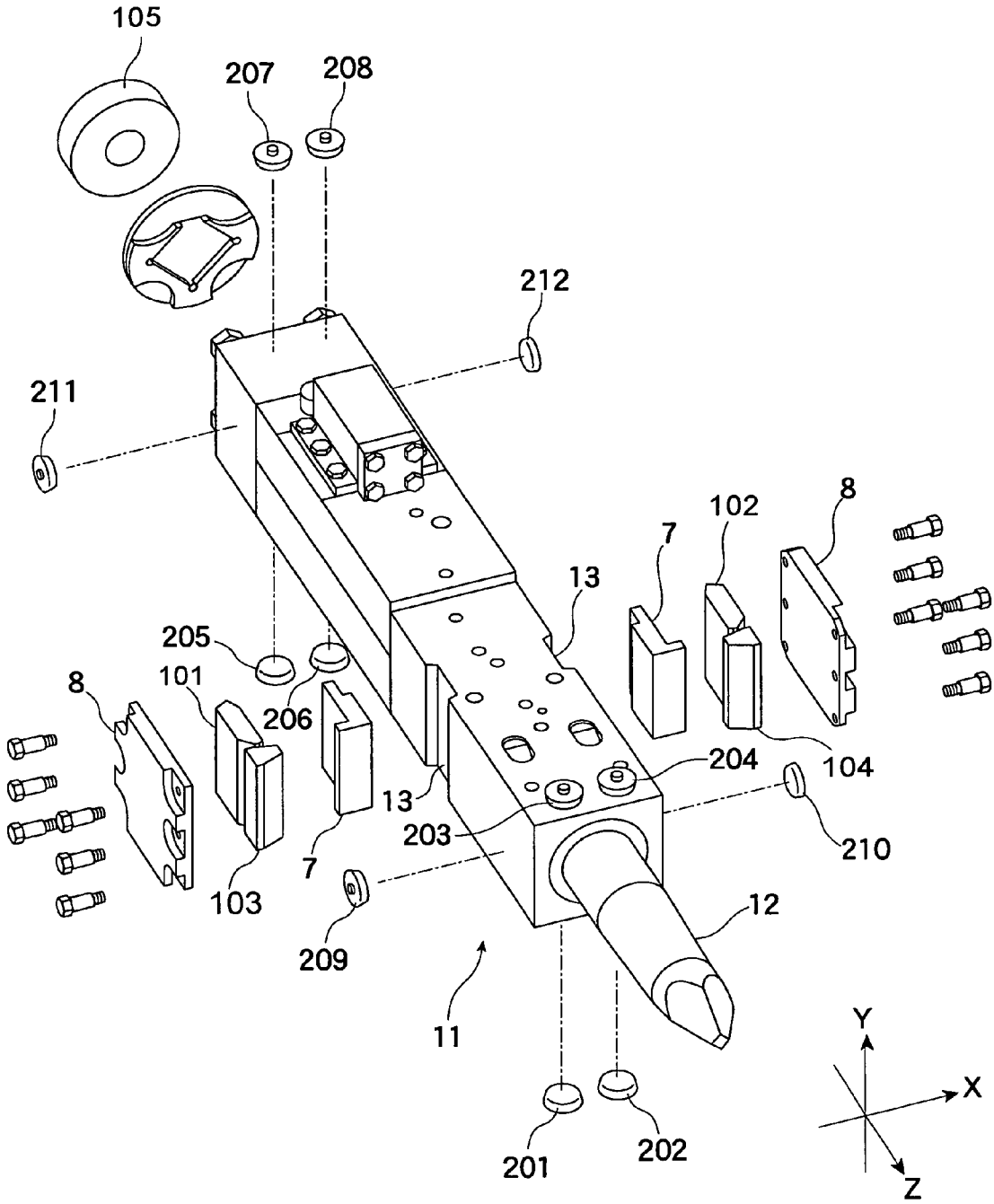
FIG. 9 is an perspective view of a breaker body and the support structure for supporting the breaker body in the embodiment 2 of the present invention.

FIG. 8A, FIG. 8B and FIG. 8C are a plan view, a side view and a front view of a breaker mounting bracket of the embodiment 2 respectively and FIG. 9 is an explanatory view of the support structure of a breaker body. Here, parts having the same functions as corresponding parts in the embodiment 1 are given the same symbols and the explanation thereof is omitted.

The breaker mounting bracket of the embodiment 2 includes left and right side plates 21 having an approximately rectangular shape which are arranged to face the both side surfaces of the breaker body 11 formed in a longitudinal and approximately rectangular parallelepiped shape and an end plate 22 having an approximately square shape which are arranged on proximal end sides of the side plates 21. Here, as shown in FIG. 9, the breaker mounting bracket includes a pair of left and right resilient bodies (first side-plate side resilient bodies) 101, 102 which are formed on respective inner sides of the left and right side plates 21 and clamps the breaker body 11 in the X direction (left and right direction of the drawing) for applying a pressing force to the breaker body 11, a pair of left and right resilient bodies (second side-plate side resilient bodies) 103, 104 which are, in the same manner, formed on respective inner sides of the left and right side plates 21 for supporting the breaker body 11 by applying a pressing force to the breaker body 11 in the Z direction (vibration direction of a chisel 12), a proximal portion resilient body (end-plate side resilient body or longitudinal resilient body) 105 which is formed in the inner side of the end-plate 22 and is brought into contact with the proximal portion of the bracket body 11 for alleviating the vibration in the Z direction between the resilient bodies 103, 104 by way of keys 7 and key grooves 13, upper-and-lower-surface side resilient bodies (third resilient bodies) 201 to 208 which are respectively brought into contact with the upper plate surface and lower plate surface of the bracket body 11 and is formed in a button shape or the like for resiliently alleviating or restricting the vibration of the bracket body 11 in the Y direction and side-plate side resilient bodies (third resilient bodies) 209 to 212 which are configured to be brought into contact with given portions of the side plates 21 and are formed in a button shape.

In this manner, the breaker body 11 is resiliently supported in three X, Y, Z directions which are orthogonal to each other by way of the side-plate side resilient bodies (first and second side-plate side resilient bodies) 101 to 104 and 209 to 212, the upper and lower surface side resilient bodies (third resilient bodies) 201 to 208 and the end-plate side resilient body 105. Specifically, the breaker body 11 is resiliently supported in the Z direction, that is, the vibration direction of the chisel 12 by way of the side-plate side resilient bodies 103, 104 and the base plate side resilient body 105 and is mounted on a distal end of an arm.

The side-plate side resilient bodies 101, 102 which are arranged to face each other and clamp the breaker body 11 in the X direction are, as shown in FIG. 9, formed of panel-like resilient rubber or the like formed between the key 7 which is arranged to be fitted in the key groove 13 and the key cover 8 in the inner side of the side plate 21. With such a constitution, while applying a given resilient pressing force to the breaker body 11 in the X direction, the vibrations are effectively alleviated and the breaker body 11 is clamped from the side surface sides.

Figure 10A:
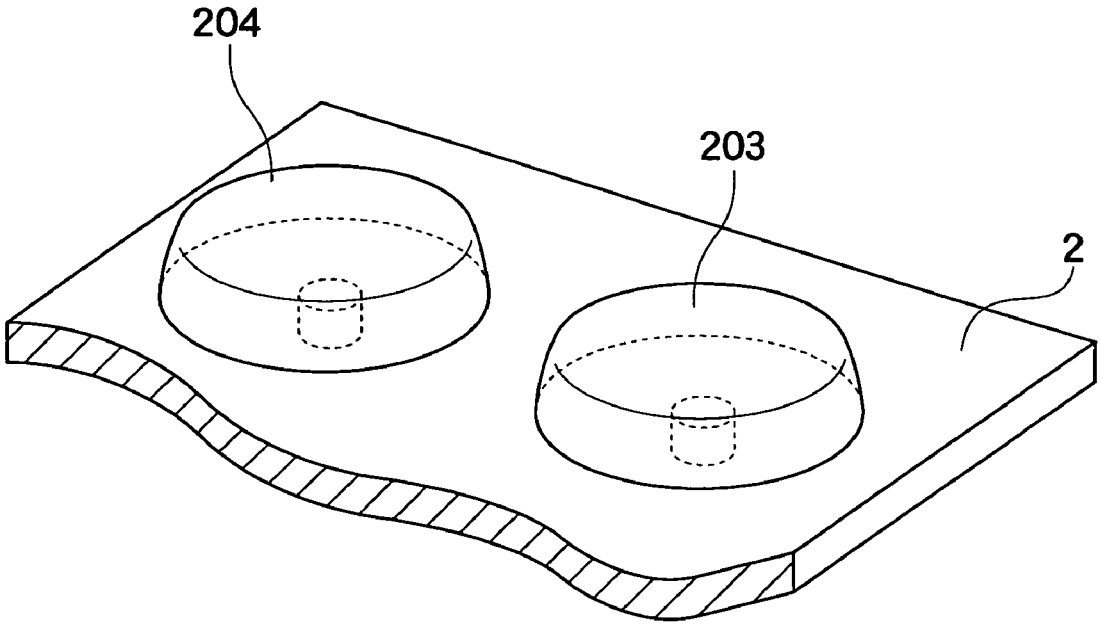
FIG. 10A is an enlarged perspective view of a resilient body in the support structure of the embodiment 2 of the present invention.
Figure 10B:
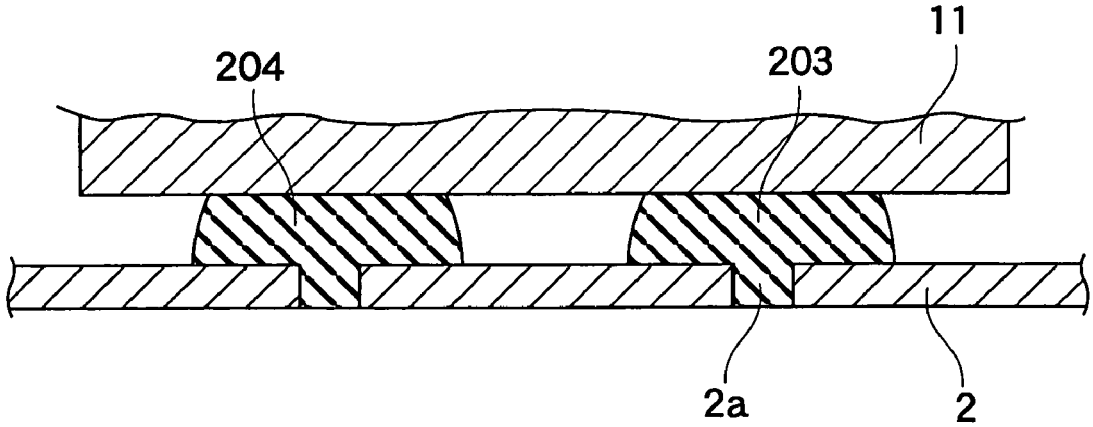
FIG. 10B is an enlarged cross-sectional view of the resilient body in the support structure of the embodiment 2 of the present invention.

The upper and lower surface side resilient bodies 201 to 208 and the side-plate side resilient bodies 209 to 212 are, as explained with the cases of the side-plate side resilient bodies 203, 204 shown in FIG. 10A and FIG. 10B as examples, formed of vibration prevention rubbers or the like which are respectively formed in an approximately disc-like shape and, proximal portions thereof formed in the centers of the plate-like bottoms are fitted in hole portions 2*a* which are formed in the upper, lower surface plates of the bracket 2 and detachably fixed to the bracket 2. Further, the plate-like top portions in the upper and lower surface side resilient bodies 201 to 208 M, the side-plate side resilient bodies 209 to 212 are arranged such that the top portions thereof are brought into contact with the upper, lower surface plates of the breaker body 11.

The vibration prevention rubber is a spring member which makes use of resiliency of rubber and is used for the purpose of preventing the transfer of the vibration impact or buffering the vibration impact. With respect to a rubber member which constitutes the vibration prevention rubbers, it is necessary that basic properties such as favorable dynamic characteristics or the fatigue resistance and properties such as compression load resistance or durability against thermal load are held in a balanced manner. With respect to rubber composition for the vibration prevention rubber, generally, in view of the dynamic characteristics and the fatigue resistance, natural rubber or the blending of the natural rubber and diene-based synthetic rubber is used as rubber component. In supporting the breaker body, the smaller the dynamic spring constant at the transferring the vibration, the vibration prevention property of the resilient bodies is increased. On the other hand, the larger the static spring constant showing support rigidity, it is possible to obtain the more favorable the support property (strength). That is, it is desirable to set the dynamic spring constant and the static spring constant within proper ranges in which the value of dynamic-to-static spring constant ratio which is a ratio of the dynamic spring constant and the static spring constant becomes small corresponding to operational conditions under which the breaker body is supported in a floating manner.

Here, these upper and lower surface side resilient bodies can be formed in a given number as upper and lower pairs if necessary. Further, it is possible to enhance the resilient support force for the breaker body 11 by detachably mounting such disc-like or panel-like resilient bodies arbitrarily on the side-plate surface sides of the breaker body other than the upper and lower surface sides thereof and to enhance the stability and durability at the time of breaker operation in response to the condition such as the use condition of the breaker body 11 by adjusting the vibration property of the breaker body 11 which is supported by the respective resilient bodies.

As has been explained hereinabove, the breaker mounting bracket of the embodiment 2 is a bracket for mounting the breaker body 11 in which the chisel 12 is mounted on the distal end of the arm of the operation device and includes resilient bodies such as the pair of left and right side plates 21 which are formed to face the both side surfaces of the breaker body 11 formed in a longitudinal and approximately rectangular parallelepiped shape and the end plate 3 having an approximately square shape which are arranged on the proximal side of the side plate 21 and on which a connection portion with the distal end of the arm of the operation device is mounted and, at the same time, includes the end-plate side resilient body 105 which is formed in the inner side of the end plate 3 and is brought into contact with the proximal portion of the breaker body 11, the side-plate side resilient bodies 103, 104 which are formed in the inner sides of the respective left and right side plates 21 and support the breaker body 11 in the vibration direction of the chisel 12 (Z direction) in cooperation with the end-plate side resilient body 105, the side-plate side resilient bodies 101, 102 which are communicably connected with the side-plate side resilient bodies 103, 104 for applying the pressing force to the breaker body 11 in the X direction, the upper and lower surface side resilient bodies 201 to 208 which are brought into contact with the upper and lower surfaces of the breaker body 11 and supports the breaker body 11, the side-plate side resilient bodies 209 to 212 for reinforcing the support force of the breaker body in the X direction. Accordingly, a given pressing force can be applied to the breaker body 11 by way of the respective resilient bodies 101 to 105 and 201 to 212 and hence, the applied impact force can be specifically effectively alleviated. In this manner, the respective impact forces applied to the respective resilient bodies can be suitably balanced and the durability and the dynamic stability of the resilient bodies can be ensured.

The present invention has been explained according to the embodiment 1 and the embodiment 2 heretofore. However, the gist of the breaker mounting bracket in accordance with the present invention lies in that the resilient bodies which can apply a given resilient force are mounted on the breaker body and the constitutions relevant to the gist belong to scope of claims of the present invention. For example, in this embodiment, the rubber bodies which are formed of synthetic resin or the like are used as the resilient body. However, the resilient body is not limited to these rubber bodies, and a metal-made coil spring, a leaf spring, a pneumatic spring or a composite of these resilient bodies can be applied. Further, the respective arrangement position, the number and the amount, the shape, the size of the resilient body is not limited to the arrangement the position, the number and the amount, the shape, the size of the resilient body described in the embodiments and can be suitably adjusted in conformity with the use condition thereof.

What is claimed is:

1. A breaker mounting bracket for mounting a breaker body on a distal end of an arm of a working machine wherein the breaker body includes:

opposing side surfaces each having an engagement groove with opposing engagement groove side surfaces and an engagement groove recessed surface therebetween, a breaker body end surface supported proximate said distal end of said arm; and an operational axis of breaking action of the breaker body defining a longitudinal direction, the breaker mounting bracket comprising:

a housing having first and second housing sides opposing each other and between which said breaker body is accepted, and a housing end configured to attach to said distal end of said arm;

first and second engaging members each having an L-shaped configuration including:

a first plate portion having an engaging portion configured to fit in said engagement groove, the engaging portion having a first engaging member surface configured to contact the engagement groove recessed surface;

a second plate portion extending orthogonally from said first plate portion in a direction away from said operational axis and presenting a second engaging member surface oriented orthogonal to said operational axis; and said first plate portion having a third engaging member surface on a side opposite said first engaging member surface;

an end resilient body disposed in said housing so as to oppose said breaker body end surface to absorb vibrations of said breaker body in the longitudinal direction;

first side resilient bodies respectively disposed engaging said first and second housing sides and supporting said second engaging member surfaces of said first and second engaging members so as to absorb vibrations of said breaker body in the longitudinal direction in cooperation with said end resilient body;

second side resilient bodies respectively disposed engaging said first and second housing sides and supporting said third engaging member surfaces of said first and second engaging members in a lateral direction orthogonal to the longitudinal direction so as to absorb vibrations of said breaker body in the lateral direction; and said first and second side resilient bodies being detachably engaged with said second and third engaging member surfaces and disposed such that said second plate portions of said first and second engaging members are interposed in the longitudinal direction between respective ones of said first and second resilient bodies.

2. A breaker mounting bracket according to claim 1, wherein:

said housing has an inner end surface, said first and second housing sides each have a first side surface arranged orthogonal to said operational axis, and a second side surface oriented parallel to said operational axis;

said second engaging member surfaces are arranged facing respective ones of said first side surfaces with said first side resilient bodies disposed therebetween; and said third engaging member surfaces are disposed opposing respective ones of said second side surfaces with said second side resilient bodies therebetween.

3. A breaker mounting bracket according to claim 2, wherein:

said first and second housing sides respectively include first and second side plates arranged to face each other in an opposed manner, said first and second side plates having, at opposed ends in the longitudinal direction, first and second side plate end portions; and said housing includes an end plate provided between and connecting said first side plate end portions and configured to be connected to the distal end of the arm of the working machine.

4. A breaker mounting bracket according to claim 3, wherein:

said first and second engaging members are embodied as keys;

said first and second side plates each include a guide aperture and a key guide member disposed aligned with the guide aperture and having a key aperture with said first and second side resilient bodies disposed within the key aperture along with said second plate portion;

said first side surfaces being a side surface of said key aperture of each of said key guides; and said first and second housing sides include key covers covering said guide apertures, and said second side surfaces are surfaces of said key covers.

5. The breaker mounting bracket according to claim 4, further comprising third resilient bodies mounted on said first and second side plates so as to engage, support and absorb vibrations of the breaker body in the lateral direction orthogonal to the operational axis along which the chisel operates.

6. The breaker mounting bracket according to claim 5, wherein a chisel is mounted on the breaker body an operates along the operational axis, and the breaker body is formed in a longitudinal elongated rectangular parallelepiped shape, and wherein:

the end plate is an approximately square end plate; and the end resilient body is arranged on an inner side or the end plate and is brought into contact with the breaker body end surface of the breaker body.

7. The breaker mounting bracket according to claim 6, further comprising:

the housing having third and fourth side plates opposing one another and positioned to accept said breaker body therebetween; and further third resilient bodies mounted on said third and fourth side plates so as to engage, support and absorb vibrations of the breaker body in another lateral direction orthogonal to said lateral direction and the operational axis.

8. The breaker mounting bracket according to claim 2, further comprising:

the housing having third and fourth housing sides opposing one another and positioned to accept said breaker body therebetween; and third resilient bodies mounted on said third and fourth housing sides so as to engage, support and absorb vibrations of the breaker body in another lateral direction orthogonal to said lateral direction and the operational axis.

9. The breaker mounting bracket according to claim 3, further comprising:

the housing having third and fourth side plates opposing one another and positioned to accept said breaker body therebetween; and third resilient bodies mounted on said third and fourth side plates so as engage, support and absorb vibrations of the breaker body in another lateral direction orthogonal to said lateral direction and the operational axis.

10. The breaker mounting bracket according to claim 4, further comprising:

the housing having third and fourth side plates opposing one another and Positioned to accept said breaker body therebetween; and third resilient bodies mounted on said third and fourth side plates so as to engage, support and absorb vibrations of the breaker body in another lateral direction orthogonal to said lateral direction and the operational axis.

11. The breaker mounting bracket according to claim 5, further comprising:

the housing having third and fourth side plates opposing one another and positioned to accept said breaker body therebetween; and further third resilient bodies mounted on said third and fourth side plates so as to engage, support and absorb vibrations of the breaker body in another lateral direction orthogonal to said lateral direction and the operational axis.

12. The breaker mounting bracket according to claim 1, further comprising:

the housing having third and fourth housing sides opposing one another and positioned to accept said breaker body therebetween; and third resilient bodies mounted on said third and fourth housing sides so as to engage, support and absorb vibrations of the breaker body in another lateral direction orthogonal to said lateral direction and the operational axis.

* * * * *